US006354101B1

(12) United States Patent
Levitin et al.

(10) Patent No.: US 6,354,101 B1
(45) Date of Patent: Mar. 12, 2002

(54) DEVICE FOR INCREASING THE EFFICIENCY OF AN AIR-COOLED CONDENSER

(76) Inventors: Mikhail Levitin, P.O. Box 102, Reeders, PA (US) 18352; Boris Khaytin, P.O. Box 102, Reeders, PA (US) 18352-0102

( * ) Notice: Subject to any disclaimer, the term of this patent is extended or adjusted under 35 U.S.C. 154(b) by 0 days.

(21) Appl. No.: 09/668,277

(22) Filed: Sep. 25, 2000

(51) Int. Cl.[7] ..... F28D 5/00

(52) U.S. Cl. ..... 62/305; 62/274; 62/279; 62/281; 62/315

(58) Field of Search ..... 62/274, 279, 281, 62/305, 315

(56) References Cited

U.S. PATENT DOCUMENTS

| | | | | | |
|---|---|---|---|---|---|
| 3,651,660 | A | * | 3/1972 | Quiros | 62/279 |
| 3,984,995 | A | * | 10/1976 | Starr et al. | 62/305 |
| 4,135,370 | A | * | 1/1979 | Hosoda et al. | 62/274 |
| 4,361,525 | A | * | 11/1982 | Leyland | 261/152 |
| 5,271,241 | A | * | 12/1993 | Kim | 62/285 |
| 5,682,757 | A | * | 11/1997 | Peterson | 62/259.2 |
| 5,706,669 | A | * | 1/1998 | Lee | 62/281 |

* cited by examiner

*Primary Examiner*—William Doerrler
*Assistant Examiner*—Mark S. Shulman

(57) ABSTRACT

The present invention relates to a device for increasing the efficiency of an air-cooled condenser by using condensation from an evaporator to reduce the energy consumption of an air conditioning system.

4 Claims, 1 Drawing Sheet

DEVICE FOR INCREASING THE EFFICIENCY OF AN AIR-COOLED CONDENSER

INTRODUCTION

This invention relates generally to air conditioning systems and more particularly, to a condensation disposal system for a packaged terminal air conditioner. Warm air is frequently humid, i.e. it contains water vapor. During the operation of an air conditioning system in the cooling mode, the refrigerant evaporator system reduces the temperature of the air to a level below its dew point and water vapor condenses on the evaporator. Some means must be provided to dispose of this condensation. In small unit air conditioners, such as in a window or wall mounted room air conditioners, a common means to accomplish the disposal of condensation is to provide a condensation collection and drain path that connects the indoor and outdoor sections of the air conditioner. Condensation formed on the system evaporator drains into a collector in the indoor section and then flows to a location under or near the condenser fan in the outdoor section.

The present invention provides a condensation distribution device to pick up the condensation and cause it to flow onto the hot surface of the condenser system where the water evaporates. Such an arrangement eliminates the need for an inconvenient, unsightly and costly condensation drain from the air conditioner. This provides for an economical use of the condensation in that the energy necessary to evaporate the water is used to assist in the cooling of the warm refrigerant in the condenser, thus resulting in an improvement in system efficiency.

BACKGROUND OF THE INVENTION

Common condensation distribution schemes include vortex impellers or aspirators, slinger rings, and mechanical pumps or specially designed fan blade tips. As described in U.S. Pat. No. 605,539 by Kenneth J. Meyer, issued Jul. 11, 2000, for window room air conditioners and packaged terminal air conditioners, it is most common to use a slinger arrangement associated with a condenser fan. In a typical slinger arrangement, a blow-through propeller fan coil configuration is used and the condensation collects at a location where the fan structure causes the condensation to be splashed onto the condenser coil, where it is evaporated, thereby, providing cooling to the condenser. The effectiveness of such a condensation disposal system, i.e. wherein a propeller fan is used to distribute the cold condensation generated by the indoor coil to be evaporated on the hot outdoor coil is dependent on many factors. The effectiveness is negligible because of the inequality of distribution of the condensation onto the condenser coil surface and contamination of this surface by salts or different impurities that occur in the condensation.

In U.S. Pat. 6,065,299 by Chen Tsai Chi issued May 23, 2000 for window room air conditioners it is proposed that a special mechanism located in front of the condenser be used, so that the condenser will be located between the mechanism and the cooling fan. The effectiveness of the mechanism is negligible because of the reduction of airflow through the condenser due to the increased hydraulic resistance to airflow passage through the condenser. The degree of this resistance could increase due to the contamination of the surface of the mechanism by impurities, which occur in the outside air.

Finally, since the full benefit of the use of condensation to cool the condenser coil is not gained for the reasons discussed herein, the condensing temperature is not lowered as much as would otherwise occur, thereby resulting in a higher evaporation temperature and less condensation being formed. The efficiency of the system will be reduced. Accordingly, the need exists for improving the device that increases the efficiency of air conditioners.

SUMMARY OF THE INVENTION

Briefly, in accordance with one aspect of the invention, a packaged terminal air conditioner is provided with a device for using condensation from the evaporator to reduce the energy consumption of an air conditioner. This device is placed in front of a condenser where air enters and is located between the condenser and fan feeding the condenser.

According to the first embodiment of the invention the device is comprised of several rods fixed on a bar. A porous material with a capillary structure such as ceramics, fabric, wire gauze net, and others covers the surfaces of the rods and bar. According to the second embodiment of the invention the device is comprised of one or several heat pipes. The cool ends of the pipes are covered by a porous material with a capillary structure such as ceramics, fabric, wire gauze net, and others. In the drawings as hereinafter described, preferred embodiments are depicted. However, various other modifications and alternate constructions can be made thereto without departing from the true spirit and scope of the invention.

BRIEF DESCRIPTION OF THE DRAWINGS

Detailed descriptions of the preferred embodiment of the invention will be made with reference to the accompanying drawings.

DETAILED DESCRIPTION OF THE PREFERRED EMBODIMENTS

Figure 1:
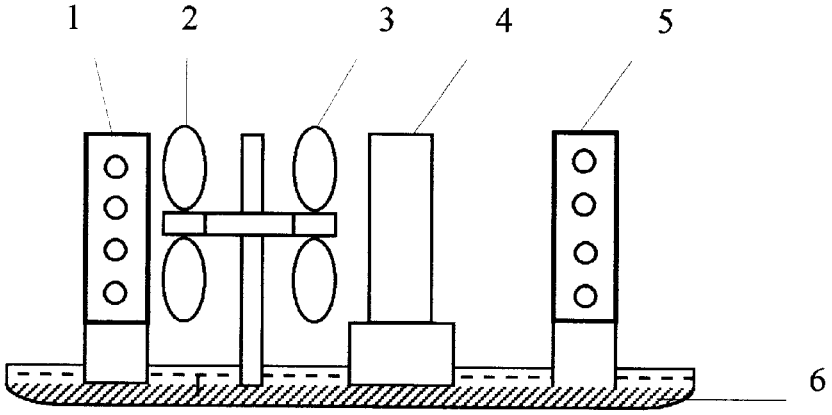
FIG. 1 is a view of a packaged terminal air conditioner with the present invention incorporated therein.

Referring to FIG. 1, there is shown a packaged terminal air conditioner with the invention shown generally at 4. The unit includes an evaporator 1 with its fan 2, a condenser 5 with cooling fan 3, and a device 4 according to the present invention all installed on the dripping pan 6.

Figure 2:
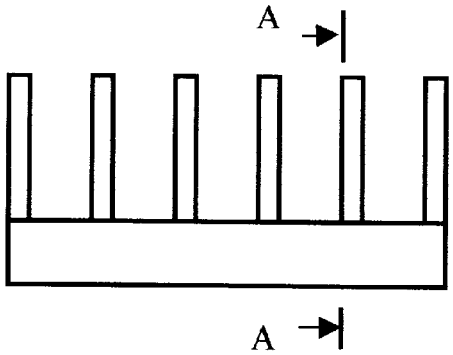
FIG. 2 is a view of the offered device according to the first embodiment of the present invention.
Figure 3:
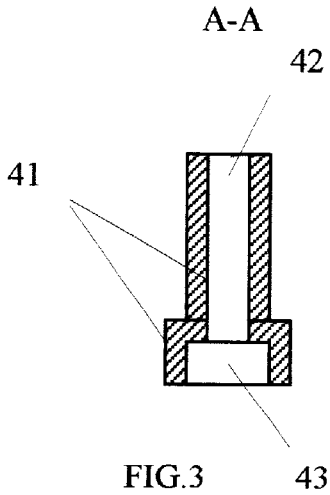
FIG. 3 is a sectional view of the device according to the first embodiment of the present invention.

FIGS. 2–3 show the offered device according to the first embodiment of the present invention comprised of several rods 42 connected to the bar 43 while the outer surfaces of rods 42 are covered with a porous material with capillary structure such as ceramics, fabric, wire gauze net, and others.

Water condensed from the air discharged by fan 2 and cooled in an evaporator 1 is collected on the dripping pan 6. When the water reaches the bar 43 it is adsorbed onto the porous material 41 and drained to the surfaces of rods 42. This water evaporates due to the ambient air blown off by the cooling fan 3 and vapor reaches the condenser 5. As a result this vapor becomes cooler and results in the cooling of condenser 5. Thus, the energy consumption of an air conditioner is reduced.

Figure 4:
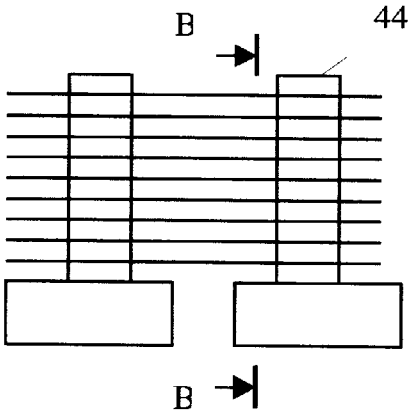
FIG. 4 is a view of the offered device according to the second embodiment of the present invention.
Figure 5:
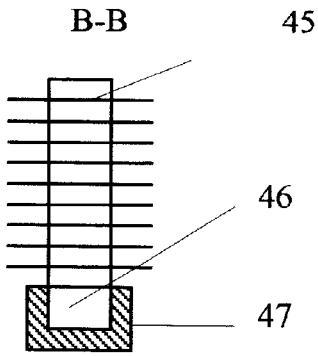
FIG. 5 is a sectional view of the device according to the second embodiment of the present invention.

FIGS. 4–5 show the offered device according to the second embodiment of the present invention comprised of one or several heat pipes 44 with evaporator 45 and cool ends 46, with the ends 46 covered by a porous material 47 with capillary structure such as ceramics, fabric, wire gauze net, etc.

Water condensed from the air discharged by fan 2 and cooled in an evaporator 1 collects in the dripping pan 6. When the water reaches the cool ends 46 it is adsorbed onto the porous material 47. This water is evaporated due to the ambient air blown off by the cooling fan 3 and thus vapor reaches the condenser 5. As a result this vapor becomes cooler and condenser is cooled by air with a reduced temperature. Thus, the energy consumption of an air conditioner is reduced.

What is claimed is:

1. An air conditioner comprised of an evaporator with a fan, a condenser with a cooling fan, a dripping pan, and a device for using condensation from the evaporator while said device is placed in front of a condenser where air enters the condenser and is located between the condenser and fan feeding the condenser with the air.

2. A device for using condensation from an evaporator as stated in claim 1, wherein said device is comprised of several rods connected to the bar while the outer surfaces of said rods are covered with a porous material with a capillary structure.

3. A device for using condensation from an evaporator as stated in claim 2, the porous material is ceramics, fabric, wire gauze net, and others, a device for using condensation from an evaporator as stated in claim 1, wherein said device is comprised of one or several heat pipes with evaporative and cool ends, respectively, with their cool ends covered by a porous material with a capillary structure.

4. A device for using condensation from an evaporator as stated in claim 3 wherein said porous material is ceramics, fabric, wire gauze net, and others.

* * * * *